US009746276B2

(12) United States Patent
Hughes et al.

(10) Patent No.: US 9,746,276 B2
(45) **Date of Patent: *Aug. 29, 2017**

(54) CROSSBOW ASSEMBLY

(71) Applicant: Bear Archery, Inc., Evansville, IN (US)

(72) Inventors: Andrew Hughes, Evansville, IN (US); Emily Shipley, Evansville, IN (US); Luke Thorkildsen, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/276,915

(22) Filed: Sep. 27, 2016

(65) Prior Publication Data

US 2017/0051997 A1 Feb. 23, 2017

Related U.S. Application Data

(63) Continuation of application No. 15/075,592, filed on Mar. 21, 2016, now Pat. No. 9,464,861, which is a continuation of application No. 14/973,813, filed on Dec. 18, 2015, now Pat. No. 9,303,945.

(60) Provisional application No. 62/206,500, filed on Aug. 18, 2015.

(51) Int. Cl.

| | |
|---|---|
| ***F41B 5/12*** | (2006.01) |
| ***F41G 11/00*** | (2006.01) |
| *F41A 11/00* | (2006.01) |

(52) U.S. Cl.

CPC ..... *F41B 5/123* (2013.01); *F41B 5/12* (2013.01); *F41G 11/003* (2013.01); *F41A 11/00* (2013.01)

(58) Field of Classification Search

CPC ..... F41B 5/12; F41B 5/123

See application file for complete search history.

(56) References Cited

U.S. PATENT DOCUMENTS

| | | | |
|---|---|---|---|
| 3,108,583 | A | 10/1963 | Andis |
| 4,169,456 | A | 10/1979 | Van House |
| 4,178,904 | A | 12/1979 | Meininger |
| 4,766,874 | A | 8/1988 | Nishioka |
| 4,879,987 | A | 11/1989 | Nishioka |
| 5,630,405 | A | 5/1997 | Nizov |
| 7,328,693 | B2 | 2/2008 | Kempf |
| 7,363,921 | B2 | 4/2008 | Kempf |
| 7,836,871 | B2 | 11/2010 | Kempf |
| 7,938,108 | B2 | 5/2011 | Popov et al. |

(Continued)

*Primary Examiner* — John Ricci

(74) *Attorney, Agent, or Firm* — Woodard, Emhardt, Moriarty, McNett & Henry, LLP; Charles Meyer

(57) ABSTRACT

A crossbow system is illustrated with a rail, a stock and a riser assembly. In certain embodiments, flexible limbs extend forward from riser assembly, in the direction of shooting, and include cams at the limb tips for the power cable arrangement at their ends. In certain embodiments, the riser assembly is made in a triangular arrangement with a crosspiece and a pair of struts extending rearward and are braced at an apex. Optionally, the crosspiece and struts can be formed separately and connected during assembly, facilitating manufacture and ease of assembly of the crossbow and allowing greater flexibility in the choice of manufacturing methods, materials and mounting arrangements.

20 Claims, 12 Drawing Sheets

(56) References Cited

U.S. PATENT DOCUMENTS 9,303,945 B1 4/2016 Hughes et al.
9,464,861 B1 * 10/2016 Hughes ..... F41G 11/003

* cited by examiner

CROSSBOW ASSEMBLY

CROSS-REFERENCE TO RELATED APPLICATIONS

This application is a continuation of U.S. patent application Ser. No. 15/075,592 filed Mar. 21, 2016, which is a continuation of U.S. patent application Ser. No. 14/973,813 filed Dec. 18, 2015, now U.S. Pat. No. 9,303,945, which claims the benefit of U.S. Provisional Patent Application No. 62/206,500 filed Aug. 18, 2015, all of which are hereby incorporated by reference.

FIELD OF THE INVENTION

The present invention relates generally to crossbows.

BACKGROUND OF THE INVENTION

Crossbows have been used for centuries for both hunting and recreation. They are characterized by limbs mounted on a stock with a bowstring that is drawn to store energy that is transferred to a bolt upon firing. Aspects of the present disclosure address different types of crossbow arrangements and assembly aspects.

In some embodiments, the features may be used alone or in combination with reverse crossbows. A traditional reverse crossbow includes limbs mounted to a frame with the limb butt portions closer to the user. The limbs curve outward and away from the user. When cocked, the limb tips are drawn generally inward toward a central portion. When released, the limb tips spring outward, causing the bowstring to travel forward and propel a projectile such as a quarrel. The reverse crossbow arrangement allows the bowstring to be drawn and released to travel a greater distance with a longer power stroke compared to a traditional "forward" crossbow, allowing greater force to be imparted to the projectile.

The concept of a reverse crossbow has been well known for decades, for example as shown in U.S. Pat. No. 3,108,583 to Andis; U.S. Pat. No. 5,630,405 to Nizov; U.S. Pat. No. 4,169,456 to Van House; U.S. Pat. No. 4,766,874 to Nishioka; U.S. Pat. No. 4,879,987 to Nishioka; U.S. Pat. No. 7,328,693 to Kempf, and U.S. Pat. No. 7,938,108 to Popov. These references show a crossbow with limbs inverted to point forward, i.e. limbs that are curved so that their ends generally point toward the front of the crossbow and having a longer power stroke.

Some reverse crossbows have a riser assembly formed of a single crosspiece, which requires that all of the force applied via the limbs is focused through the single crosspiece, which may be close to perpendicular to the limbs. The forces applied by the limbs are effectively applied against lever arms defined by the radius length of the cantilevered ends from a center connection point. In essence the stresses attempt to rotate the lever arm forward or rearward, and the crosspiece alone must withstand the applied stress. When a riser with only a perpendicular crosspiece is used, a stronger and larger crosspiece is needed or less force can be sustained in use.

To reduce stress on the crosspiece, it can be advantageous to use a triangular riser, for example a monolithic triangular riser as taught by Nizov in U.S. Pat. No. 5,630,405. In Nizov's triangular riser, a pair of bracing portions extend from the ends of a perpendicular crosspiece and are angled inward to then connect with the stock and rail. Thus, part of the force applied by the limbs to the riser is transmitted rearward via the angled bracing portions so that the stock and rail assembly may brace the angled portions at the rearward connection points and consequently help brace the crosspiece. In contrast to the crosspiece portion, which is essentially perpendicular to the stock and rail and which may be close to perpendicular to the limbs, the angled portions can be aligned closer to a forward/rearward direction, and can be more closely aligned with the forward and rearward force vectors applied to the riser by the limbs. However, manufacturing a monolithic triangular riser as taught by Nizov can be complex and expensive.

SUMMARY

In certain embodiments a crossbow assembly is illustrated with a rail, a stock and a riser assembly. Flexible limbs extend forward from the riser assembly, in the direction of shooting, and include cams at the limb tips for the power cable arrangement at their ends. The illustrated riser assembly and limb arrangement is sometimes referred to as a reverse crossbow or a reverse draw crossbow. In certain embodiments, the riser assembly is made in a triangular arrangement with a crosspiece and a pair of bracing struts extending rearward to an apex. In one form, the crosspiece and bracing struts are formed separately and connected during assembly, functionally providing the same result in use as a one-piece triangular riser yet facilitating manufacture and ease of assembly of the crossbow and allowing greater flexibility in the choice of manufacturing methods, materials and mounting arrangements.

In certain embodiments, the crosspiece and bracing struts are non-linear, for example extending rearward in a swept-V profile while rising from a center portion to limb mounting portions at a higher height. The limb mounting portions are arranged parallel to, yet offset in height from the center portion, which allow the limbs and bowstring to be horizontal and at the correct height to operate with a rail and a crossbow bolt. Various accessories can be used with the crossbow. One example accessory is an hook or L-shaped stirrup open on one side which can be mounted to the front of the crossbow.

According to a non-limiting illustrated embodiment, a reverse crossbow assembly includes a rail defining a forward and a rearward direction. The rail contains a trigger and a latch mechanism and defines a bolt guide extending from the latch mechanism in the forward direction. The rail has a rear portion with a hollow interior. A stock is mounted to the rail, forming a rail and stock assembly. A triangular riser assembly has a crosspiece with a center portion mounted perpendicular to the rail and stock assembly, with the crosspiece having a pair of lateral wings, and a pair of bracing struts extending rearward from the lateral wings to an apex. The wings are non-linear, having a swept-V profile from a top perspective while rising from the center portion to limb mounting portions at a higher height from a horizontal perspective, so that the limb mounting portions are arranged parallel to, yet offset in height from the center portion. Further, the bracing struts are non-linear both vertically and horizontally, each strut curving laterally outward and upward from the rear to the front. A rail insert is arranged internally within the rear portion of the rail, the cross-section of the rail insert matching the internal cross-section of the rear portion. Rearward ends of each of the bracing struts are anchored to the rail insert to form the apex. A pair of optional bosses are defined on the stock adjacent the rearward ends of the bracing struts to provide rearward bracing to the riser assembly during use. A pair of flexible limbs extends horizontally forward from the limb mounting portions in the direction of shooting to limb tips. A pair of cams are rotatably mounted to the limb tips, and a bowstring is mounted directly between the cams and above the bolt guide.

Additional objects and advantages of the described embodiments are apparent from the discussions and drawings herein.

DESCRIPTION OF THE ILLUSTRATED EMBODIMENTS

Figure 1:
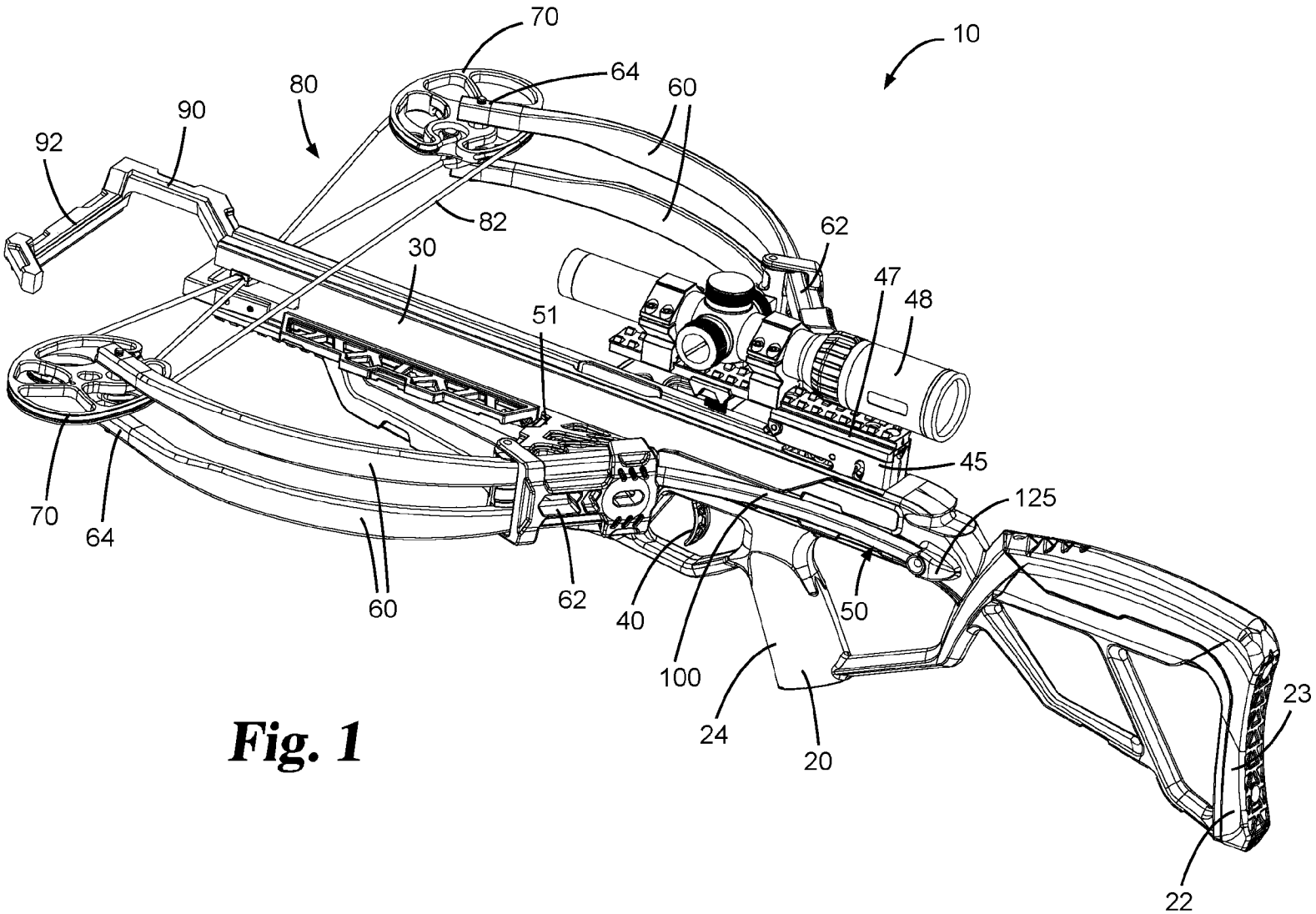
FIG. 1 is a perspective view of a crossbow in an undrawn position illustrating an embodiment of the present disclosure.
Figure 2:
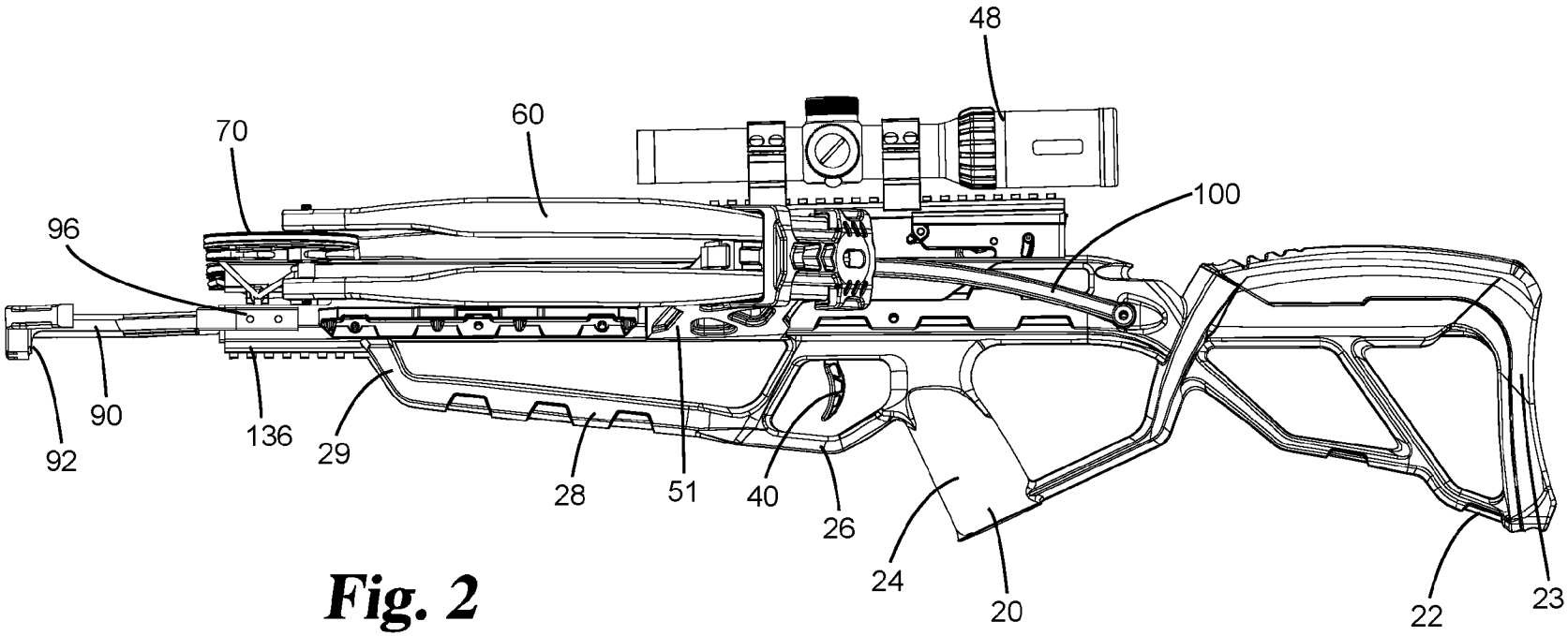
FIG. 2 is a side view of the crossbow of FIG. 1.
Figure 3:
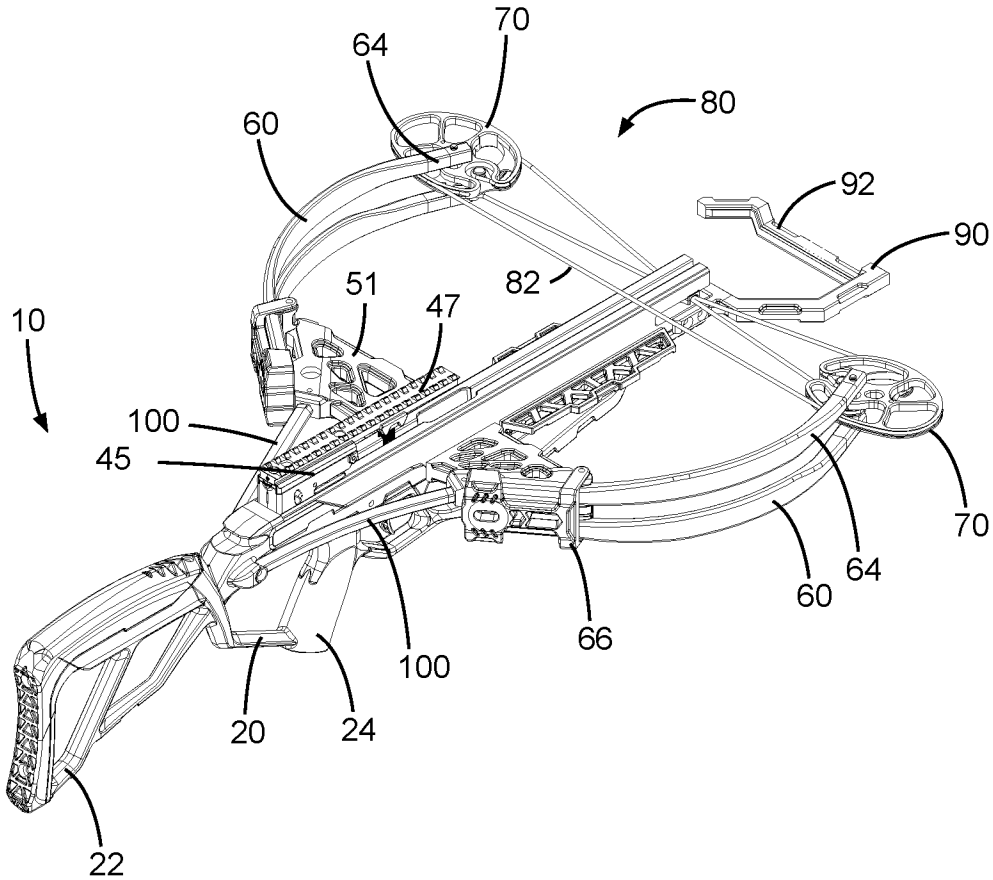
FIG. 3 is an alternate perspective view of the crossbow of FIG. 1.

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

A crossbow system is illustrated with a rail, a stock and a riser assembly. In certain embodiments, flexible limbs extend forward from the riser assembly, in the direction of shooting, and include cams at the limb tips for the power cable arrangement at their ends. The illustrated riser assembly and limb arrangement is sometimes referred to as a reverse crossbow or a reverse draw crossbow. In certain embodiments, the riser assembly is made in a triangular arrangement with a crosspiece and a pair of bracing struts extending rearward to an apex. In one form, the crosspiece and bracing struts are formed separately and then are assembled to function as a triangular riser assembly with the rail and stock, facilitating manufacture and assembly of the crossbow and allowing greater flexibility in the choice of manufacturing methods, materials and mounting arrangements.

In certain embodiments, the crosspiece is non-linear, for example extending rearward in a swept-V profile while rising from a center portion to limb mounting portions at a higher height. The limb mounting portions are arranged parallel to, yet offset in height from the center portion, which allow the limbs and bowstring to be horizontal and at the correct height to operate with rail and a crossbow bolt. The limb mounting portions may have angled edges which diverge relative to axis of the rail. In certain embodiments, the struts are non-linear both vertically and horizontally, for example curving laterally outward and upward from the rear to the front.

Various accessories can be used with the crossbow. One example accessory is a hook or L-shaped stirrup open on one side which can be mounted to the front of the crossbow.

FIGS. 1-5 illustrate a crossbow 10 shown in perspective, top, and exploded views. The crossbow system 10 includes a stock 20 and a rail 30. A trigger 40 and latch assembly 45 are arranged with the rail and stock. A riser assembly 50 is mounted to the stock 20 and rail 30, with limbs 60 extending from the riser assembly. A cable system 80 mounted on cams 70 is arranged between the limb tips 64.

The stock 20 generally defines a front end 29 and a butt end 22. For the purposes of this disclosure, the forward direction of the crossbow 10 is defined as being in the direction of shooting. The rearward direction is defined as being toward the butt end 22 of the crossbow. Directional references herein are for ease of illustration and are not intended to be limiting.

Stock 20 can be assembled as one or more pieces. The butt end 22 is at the rearward end of stock 20 and forms the rearward end of the crossbow 10. Optionally a butt pad 23 can be mounted on butt end 22 to be arranged against the user's shoulder during use. The stock 20 typically provides the user with a place to hold the crossbow system 10, such as grip 24. In the embodiment shown, stock 20 also includes a forwardly placed handle 28. A trigger guard section 26 is arranged between the grip 24 and handle 28.

In alternate embodiments, handle 28 may be a separate piece spaced and mounted forward of the trigger guard, or handle 28 may be omitted. Optionally as a separate piece, the position of the handle may be selectively adjusted forward or rearward for the user's comfort, for example by sliding the handle along the bottom of an accessory rail extending along the lower surface of rail 30 and then locking it in a desired location with a clamp or screws. Optionally, the handle may be asymmetric and reversibly mountable, for example with one end having a more horizontal aspect and the other end having a more vertical aspect, which can arranged to match a user's desired orientation.

In the embodiment shown, rail 30 is attached on top of and is partially received within a channel in stock 20. The upper surface and longitudinal axis of rail 30 defines a bolt guide, for example a pair of rails on opposites sides of a groove, upon which the shaft of a crossbow bolt can rest and which guide the bolt when released. Rail 30 includes a rearward end received within a cavity defined in stock 20, for example rearward of trigger guard section 26. The forward end 34 of rail 30 extends forward past the forward end 29 of stock 20. In other embodiments, stock 20 may extend along the length of the entire rail 30, or stock 20 and rail 30 may be formed as a single piece. In certain embodiments, rail 30 has a hollow interior. Rail 30 can be made of metal, for example using aluminum. The rail can be extruded, with desired fastener holes, slots and other openings cut or machined after the extrusion process.

Optionally, a rail cap 134 can be used to close the forward end 34 of rail 30. Further optionally, rail 30 may include an accessory mounting rail 136, sometimes called a picatinny rail, for example on the lower side of rail 30 adjacent to forward end 34. Fingerguards 138 may optionally be mounted on opposing sides of rail 30 near the front, for example adjacent and parallel to handle 28. Spacers 139 may be used in mounting fingerguards 138 to rail 30.

The trigger and latch assembly is housed within the rail 30, and extends above and below rail 30. In the illustrated embodiment, latch assembly 45 is housed within a slot 36 defined in the upper surface of rail 30. A pivotal trigger 40 extends downward through a trigger slot defined in the rail, within the space defined by the trigger guard section 26. A trigger linkage 42 operatively extends within rail 30 between trigger 40 and latch assembly 45. Latch assembly 45 includes a latch mechanism which can receive the bowstring 82 and the rear portion or nock of a crossbow bolt on top of rail 30 and holds the bowstring and bolt until it is released when a user pulls trigger 40.

When the bowstring 82 is drawn, it is pulled to a nock point in latch assembly 45, where it is held until the trigger 40 is operated to fire the bolt. The bolt then travels forward along the axis of the bolt guide of rail 30. The latch assembly may include appropriate internal operating mechanisms as well as safety mechanisms. There are a variety of trigger and latch mechanisms that are available, and any suitable mechanism for firing a bolt from crossbow 10 may be chosen. An example latch assembly is disclosed in Application Ser. No. 62/067,679 filed on Oct. 23, 2014.

The upper portion of latch assembly 45 may include an accessory mounting rail 47. A scope 48 is illustrated as an example accessory on rail 47 in FIGS. 1 and 2. Scope 48 is not included in other figures for simplicity of illustration.

Figure 6:
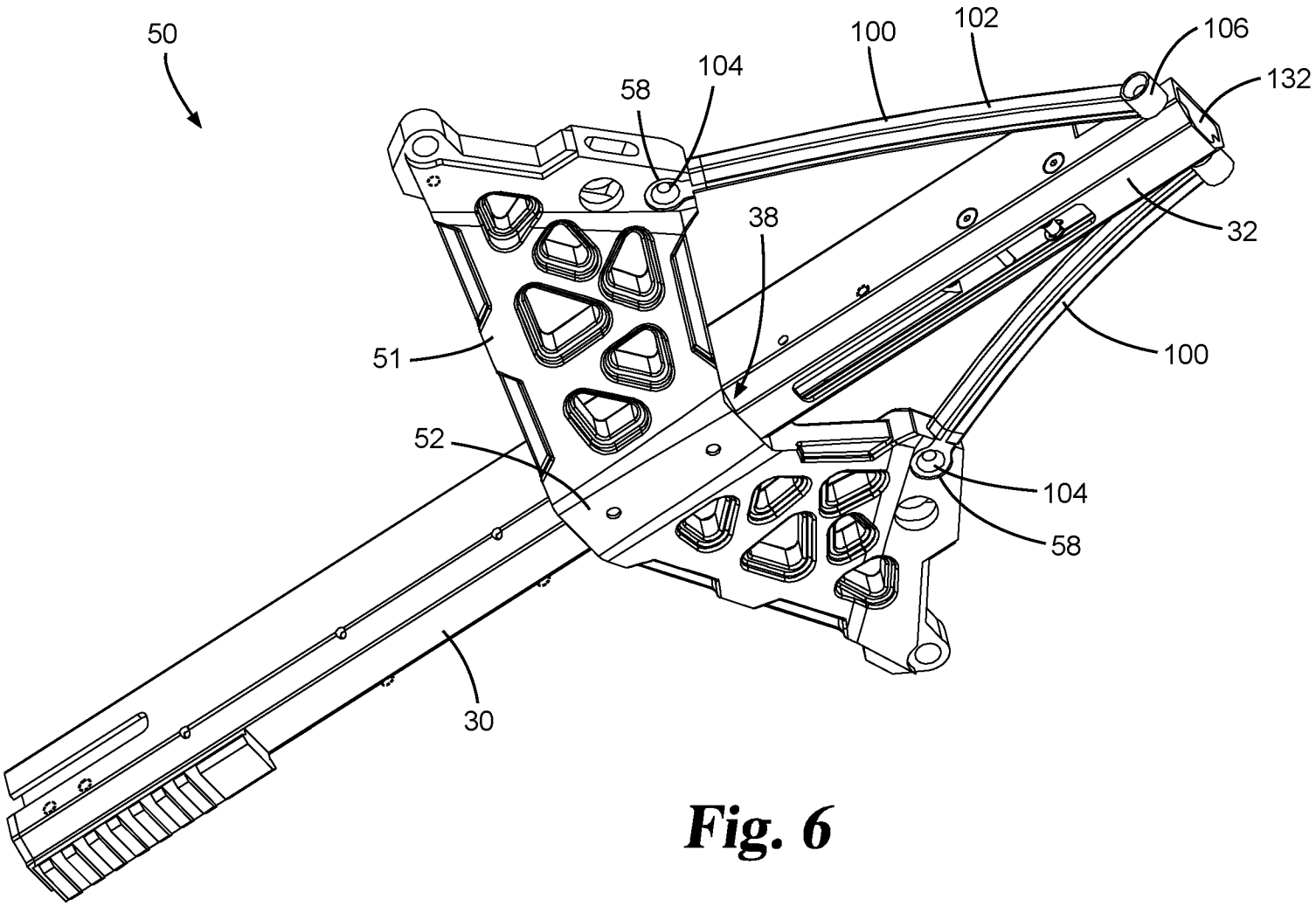
FIG. 6 is a lower, perspective view the riser assembly and rail of the crossbow of FIG. 1.
Figure 7A:
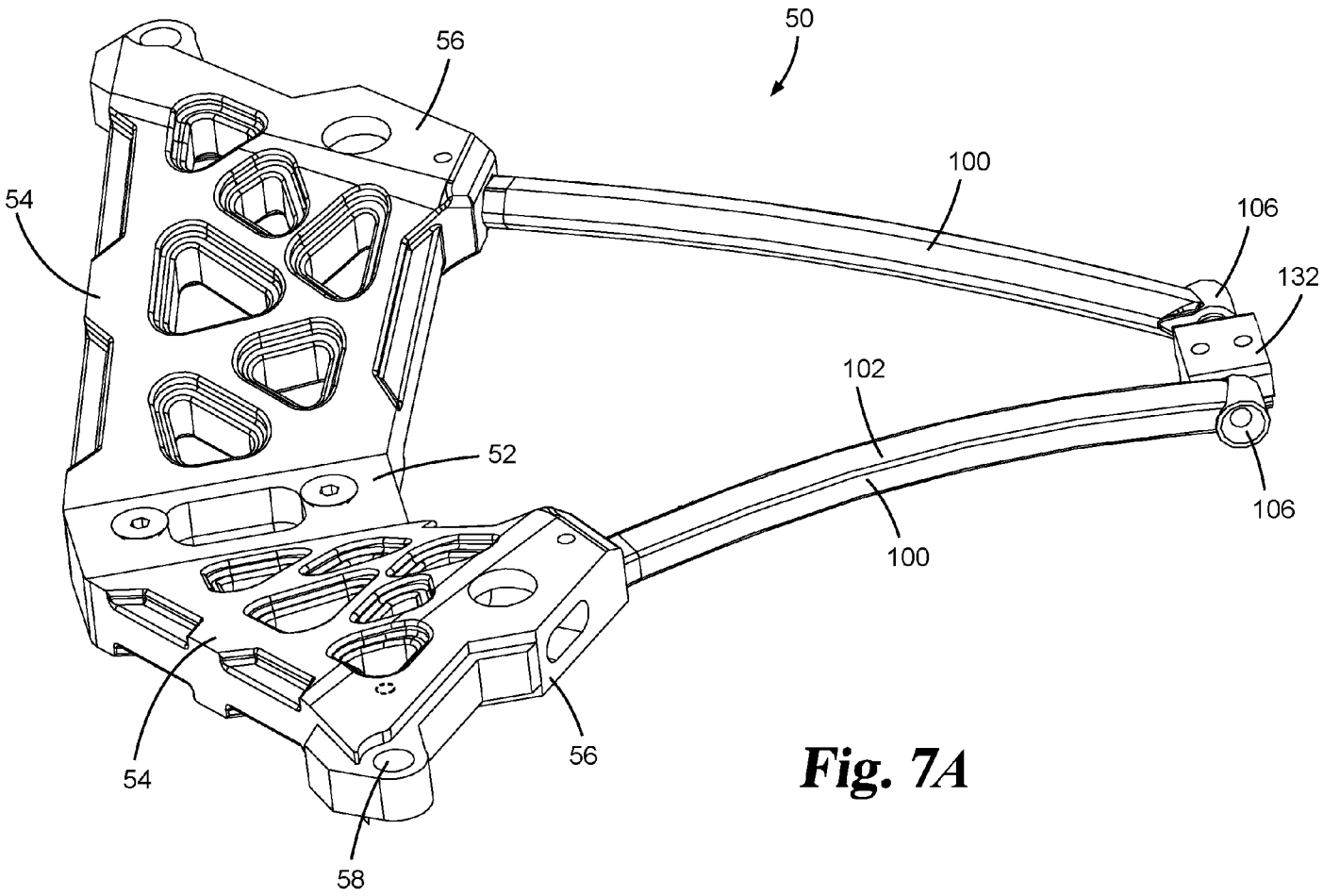
FIG. 7A is an upper perspective view of the riser assembly of FIG. 6.
Figure 7B:
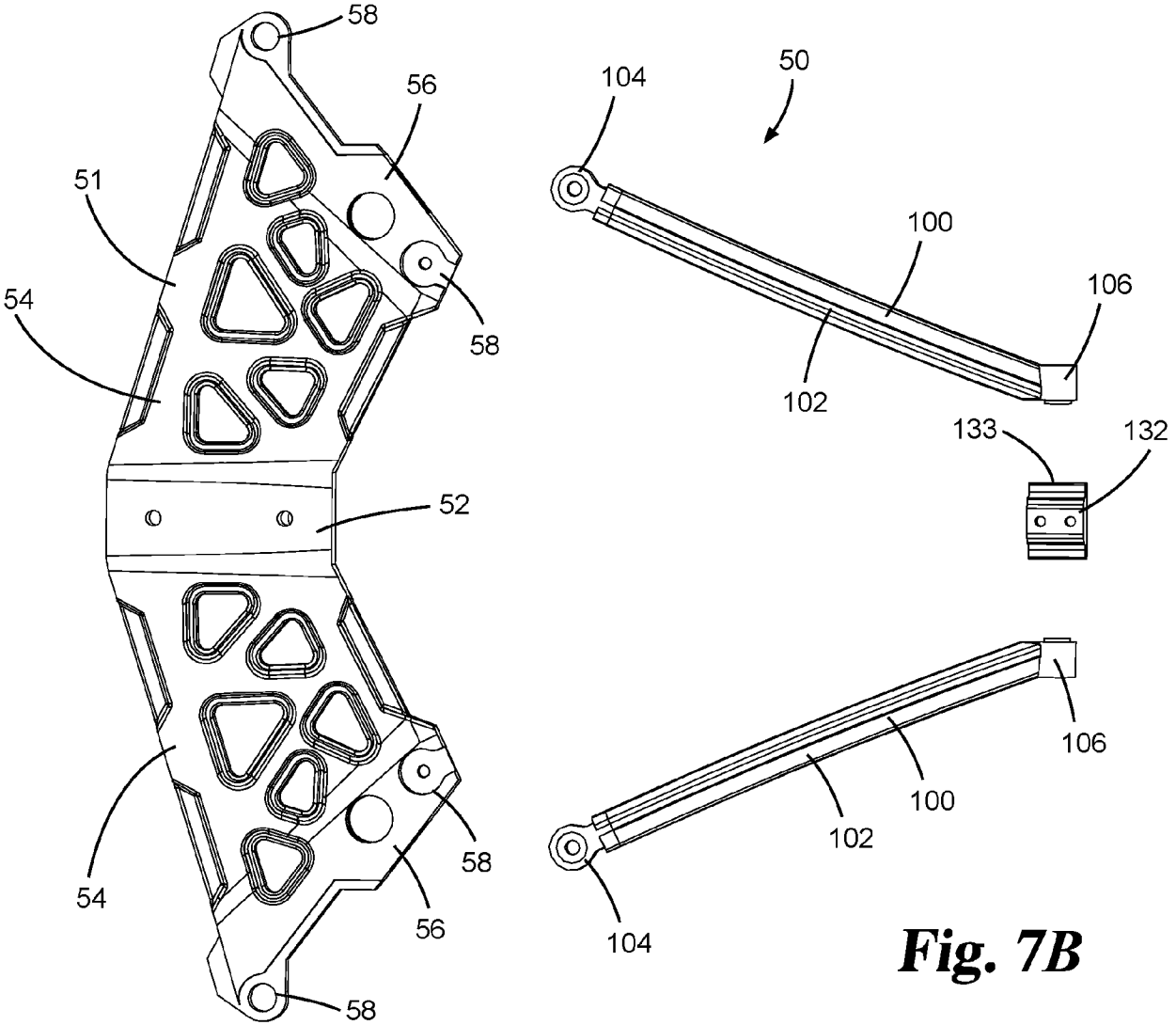
FIG. 7B is a lower exploded view of the riser assembly of FIG. 6.

Crossbow 10 includes a riser assembly 50. Aspects of riser assembly 50 are illustrated with rail 30 in FIG. 6 and in isolation in FIGS. 7A-7C. Riser assembly 50 is substantially triangular, including crosspiece 51 substantially perpendicular to rail 30 and stock 20, and a pair of bracing struts 100 which extend from the lateral wings of crosspiece 51 to rail 30 rearward of the latch assembly. In the illustrated version, crosspiece 51 is arranged between forward portions of rail 30 and stock 20. For example, a center portion 52 has a length and thickness received within a riser slot 38 defined in the lower side of rail 30 and above stock 20.

Figure 4:
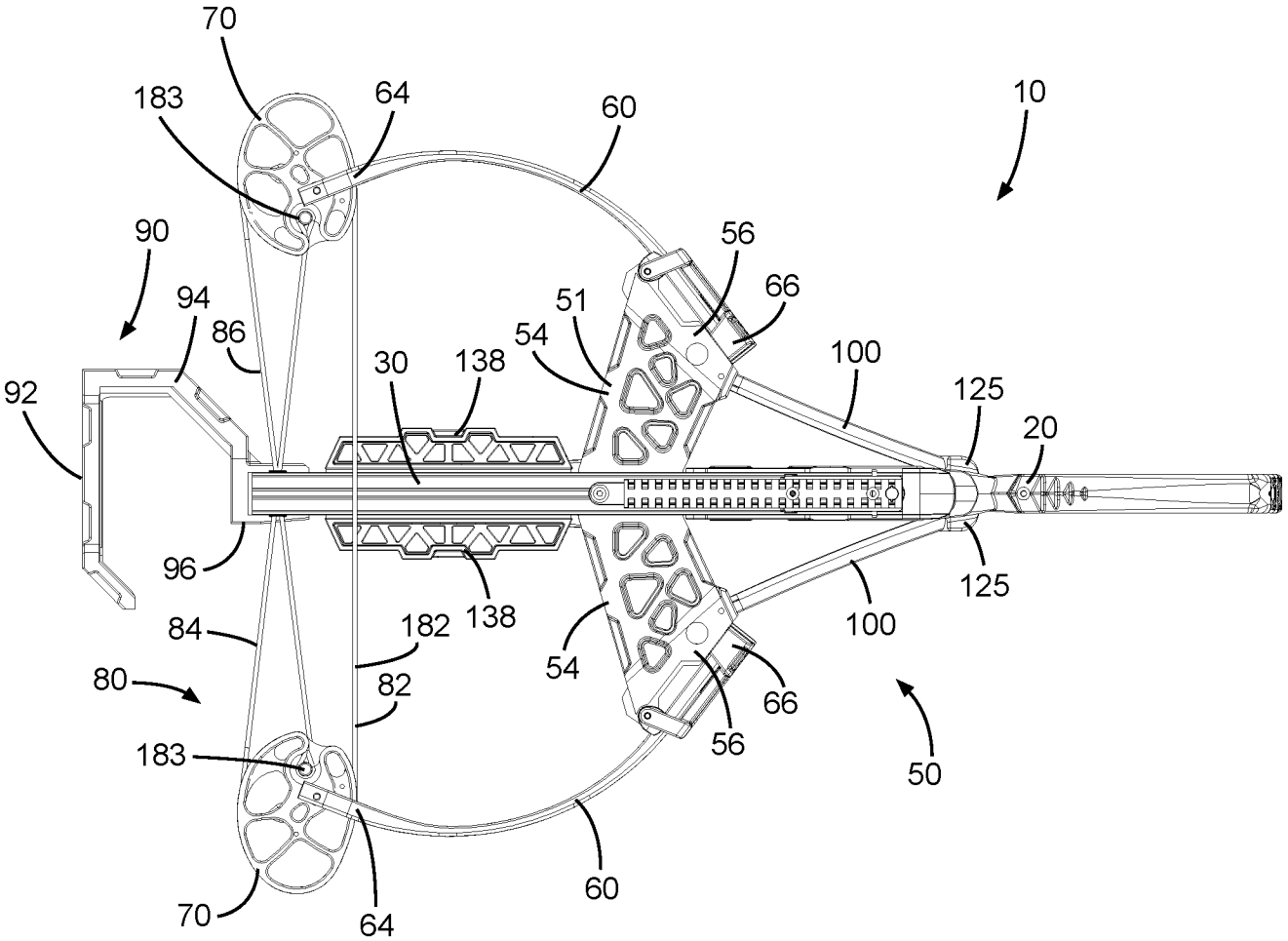
FIG. 4 is a top view of the crossbow of FIG. 1.
Figure 5:
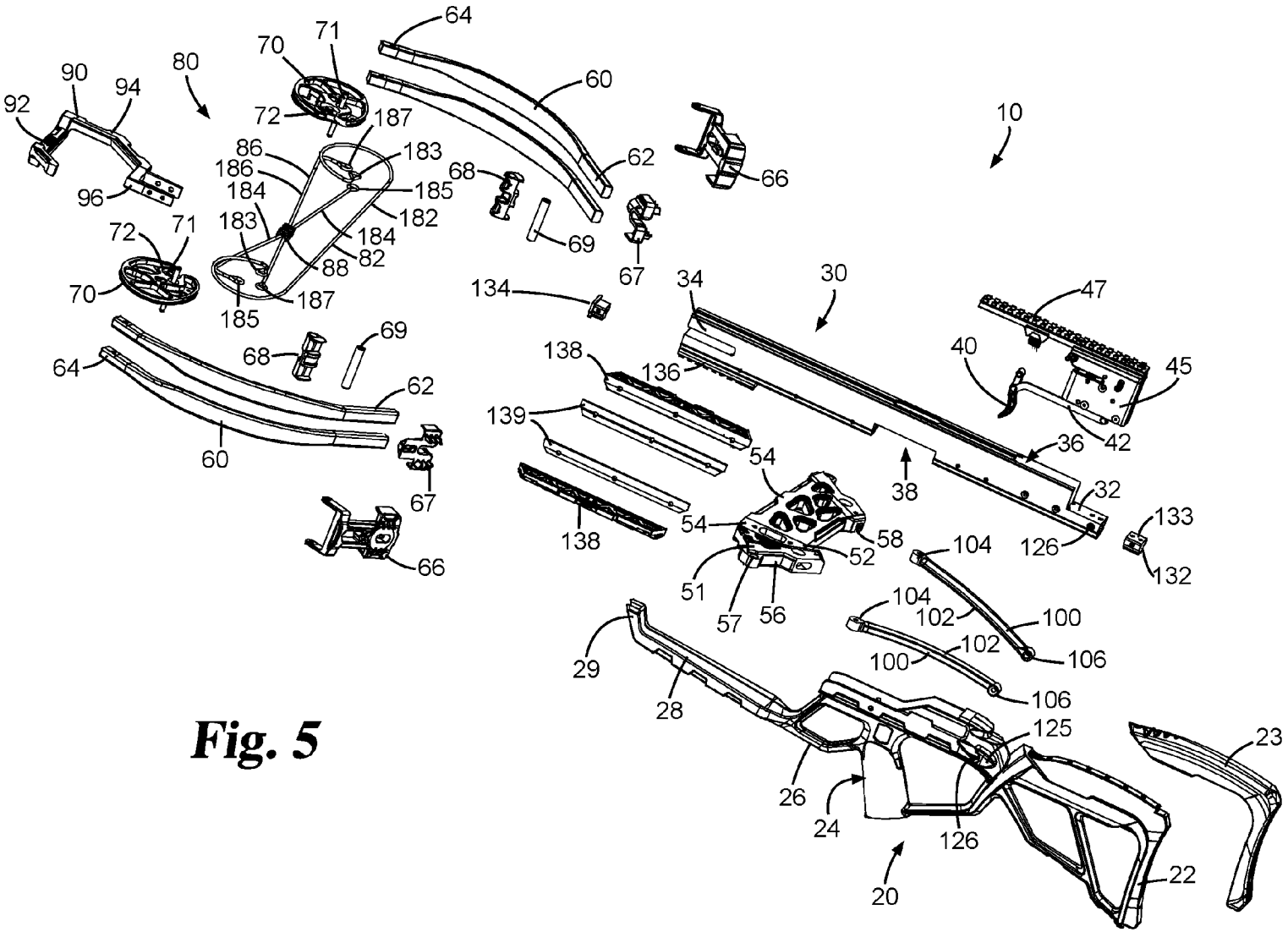
FIG. 5 is an exploded view of the crossbow of FIG. 1.

Riser crosspiece 51 includes a pair of wings 54 which extend laterally from opposing sides of center portion 52. The front and rear edges of wings 54 may be angled outward and rearward in a "swept V" profile from a top perspective (FIG. 4). The outer ends of wings 54 form a pair of limb mounting portions 56. From a top perspective, the edges of limb mounting portions 56 form angles that diverge relative to the axis of rail 30. They are non-parallel to the edges of center portion 52.

Figure 7C:
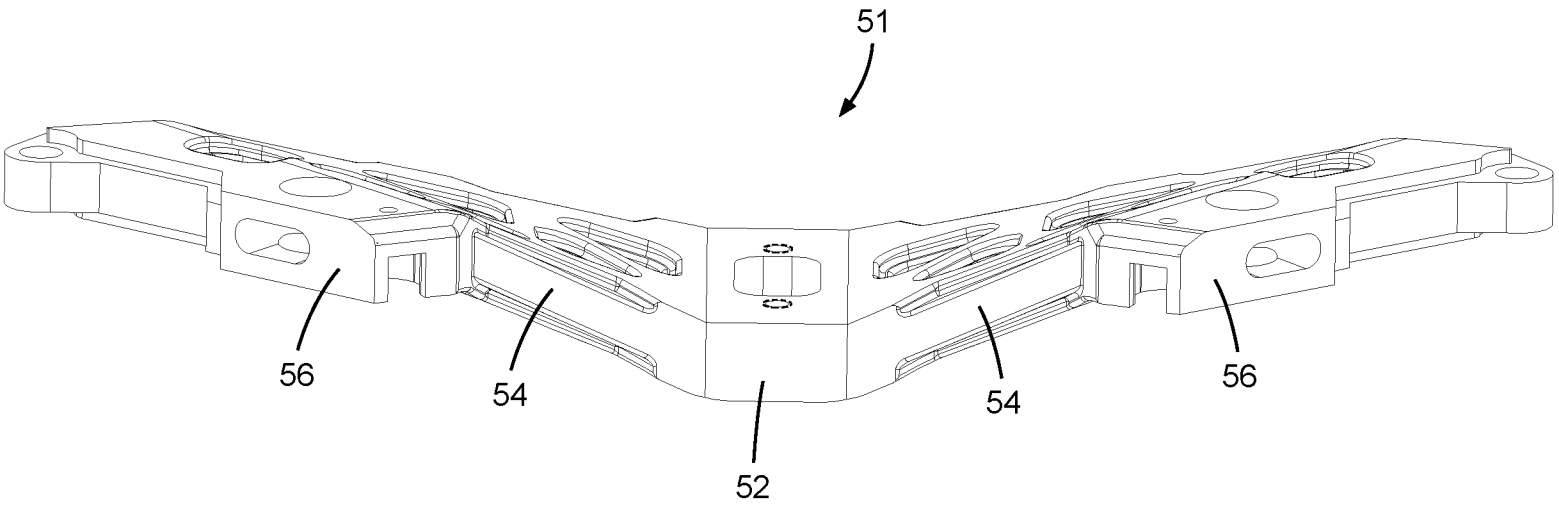
FIG. 7C is a rear, perspective view of the riser crosspiece of FIG. 6.

In the illustrated embodiment, wings 54 slant upward as they each extend horizontally/laterally from center portion 52 (e.g. FIG. 7C). The limb mounting portions 56 then level out in height to be parallel to center portion 52 from a horizontal perspective. In other words, the limb mounting portions 56 are each horizontal in a plane parallel to the plane of center portion 52 yet offset upward from center portion 52 and at a mid-point height relative to limbs 60. Due to the divergence of the limb mounting portions from a top perspective and the swept V profile of the wings, the rear corners of the limb mounting portions 56 are horizontally closer to the center axis than the forward corners yet there is an equal height difference. Correspondingly, the wing rear edges each have a length and slope, in three dimensions between center portion 51 and the respective limb mounting portion 56, which is shorter and steeper than the length and slope of each wing's corresponding forward edge. The wing surfaces proportionally transition between the rear edge to the forward edge. This creates the appearance of a slight twist in the wings between the center portion and the limb mounting portions.

In certain embodiments, crosspiece 51 may be formed of metal, for example of cast, forged or machined aluminum. Alternately, crosspiece 51 could be made of another material with sufficient strength, such as steel, a plastic or a composite material. Portions of crosspiece 51 may have material removed or "skeletonized" for aesthetics and to remove mass.

A pair of bracing struts 100 extend rearward from crosspiece 51 as part of riser assembly 50. Struts 100 each include a forward end 104 secured to crosspiece 51. Forward ends 104 are mounted to wings 54, laterally offset outward from rail 30. The connection point between struts 100 and wings 54 at points spaced along the rearward edge of wings 54 to be adjacent limb mounting portions 56. In certain embodiments, the width between the forward ends of struts 100 is maximized along the width of crosspiece 51, while making allowance for the space needed for mounting the limbs to the limb mounting portions.

As illustrated, struts 100 each include a forward end with a cross-sectional shape, such as a substantially circular cross-section extending from a neck portion, received within an opening 58 defined in crosspiece 51. Opening 58 are defined in crosspiece 51 with a vertical entrance in a lower surface and a horizontal slot along the rearward edge. The horizontal slot may have a vertical or other geometric shape, yet is horizontal in the sense that the neck portion of a bracing strut may extend through the slot horizontally. The forward end 104 of the bracing strut may have a cross-sectional size larger than the horizontal slot to opening 58, so that opening 58 receives forward end 104 vertically, but prevents forward end 104 from exiting opening 58 horizontally. Forward end 104 is then secured to crosspiece 51 within opening 58, for example using a fastener. The fastener may be permanent or removable.

Optionally, the horizontal slot to opening 58 may be slightly larger than the neck portion of the strut passing through the horizontal slot, for example defining a keyhole type of arrangement. This may allow the strut to be slightly pivoted with respect to opening 58 to assist in ease of assembly, for example allowing rearward end 106 to be rotated to its connection point after forward end 104 is within opening 58. Forward end 104 may be secured to crosspiece before or after the rearward end 106 of strut is placed at its connection point. Correspondingly, the fastener between forward end 104 and crosspiece 51 may allow or inhibit pivotal movement.

The length of each strut 100 includes a middle portion 102, which extends to a rearward end 106 opposite forward end 104. Preferably forward end 104 and rearward end 106 are integrally formed with middle portion 102, but optionally they could be separate and attached. The rearward ends 106 can be secured to form an apex to the triangular riser assembly adjacent the rear 32 of rail 30. In the illustrated embodiment, a rail insert 132 is arranged internally within the rear 32 of rail 30 to form and brace the apex. The cross-section of rail insert 132 preferably matches the internal cross-section of rail rear 32, but other geometries may be used. In certain embodiments, rail insert is formed of a substantially solid block of material which may match the material of rail 30 or which may be different. Rail insert 132 may be secured within rail 30 in various ways, for example using a pair of vertical screws, other types of fasteners, adhesive, friction, or metal bonding such as welding, or alternately the rail insert may not be directly connected to rail 30.

Rail 32 defines a pair of opposing horizontal holes 126 arranged to be aligned with a pair of opposing horizontal holes 133 in rail insert 132, which may be threaded. During assembly a horizontal passage in the rearward end 106 of each strut 100 is aligned with holes 126 and holes 133. A fastener, such as a screw, bolt or rivet, can then be placed though a passage and into the holes and tightened to anchor rearward ends 106 to rail insert 132, optionally with a portion of the rail wall sandwiched between each rearward end 106 and rail insert 132. The rail insert 132 provides a block of material with a depth into which a fastener can be secured and used to tighten and pull the strut end inward, while preventing the fastener and rearward portion 106 from applying compressive force that would deform rail 30 if rear 32 were hollow.

As arranged, struts 100 form part of riser assembly 50 and provide a bracing function to crosspiece 51. The struts assist in resisting the forces applied by the limbs which attempt to rotate the ends of the crosspiece forward and/or rearward during the draw and release cycle of the crossbow. The struts 100 provide a bracing arrangement between crosspiece 51 and the rail and rail insert, forming an overall triangular arrangement with increased stability as compared to the riser crosspiece component alone. This allows crosspiece 51 to be made of a lighter and/or more flexible material, while still maintaining sufficient rigidity and resisting rearward force applied during use. The primary force directing aspect of each strut 100 is along its length or longitudinal axis. The struts 100 may be made from the same material as crosspiece 51 and/or rail 30, or alternately can be made of a different material. For example, crosspiece 51 may be aluminum while the struts are formed as shafts made out of composite material, a plastic or a polymer such as glass filled nylon. Alternately, strut 100 may be made of a lighter or heavier metal material than crosspiece 51. Struts 100 may also be used as carrying handles.

In certain embodiments, bracing struts 100 can be arranged in a floating arrangement with respect to rail 30 and stock 20. More specifically, rearward ends 106 can be each anchored to rail insert 132 with the ends and a fastener directly engaging the rail insert, passing into rail 30 through an opening yet without directly connecting to rail 30 or stock 20. Force transmitted along a strut is then transmitted directly to the rail insert, and not directly to the rail or stock. Optionally, a dampening material can be placed between the rail insert and the rail. With both struts engaging the rail insert, the force is directed primarily within the triangular riser assembly. In certain embodiments, a single fastener such as a bolt or cotter pin can extend through the rear ends of both struts, with the rail insert in the middle, directly connecting the struts to each other.

In certain embodiments, stock 30 may optionally define a pair of bosses 125 arranged adjacent rearward ends 106 when the struts are in position. Bosses 125 may partially shield rearward ends 106, and may assisting in bracing rearward ends 106 during use.

Making the triangular riser assembly in three pieces and then assembling them to function together provides advantages in both manufacturing and assembly of the riser assembly and crossbow. For example, the center and wings of the cross-piece can be formed by forging, casting or machining just that piece without needing a piece equaling the entire size of the riser assembly. Further, the unitary aspect of crosspiece 51 provides more lateral stability widthwise for the limb mounts. Further, the bracing struts can be made in a different manner and/or of a different material, and assembled before, during or after the crosspiece is assembled with the rail and stock.

Figure 8:
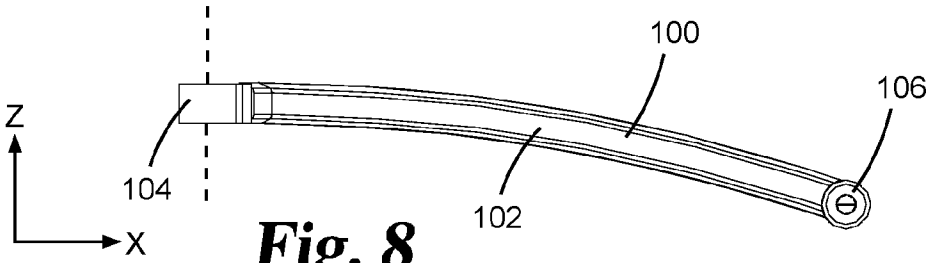
FIG. 8 is a side view of a riser strut for the riser assembly of FIG. 6.
Figure 10:
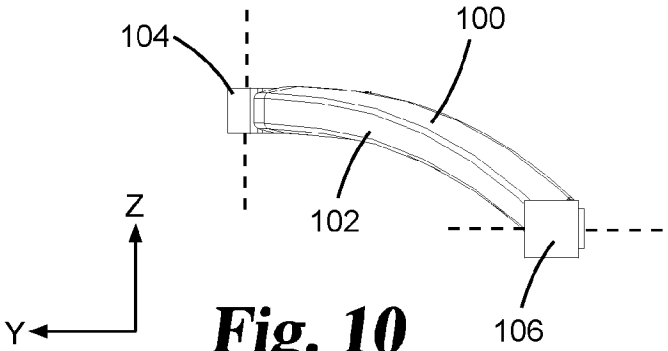
FIG. 10 is a rear view of a riser strut for the riser assembly of FIG. 6.
Figure 9:
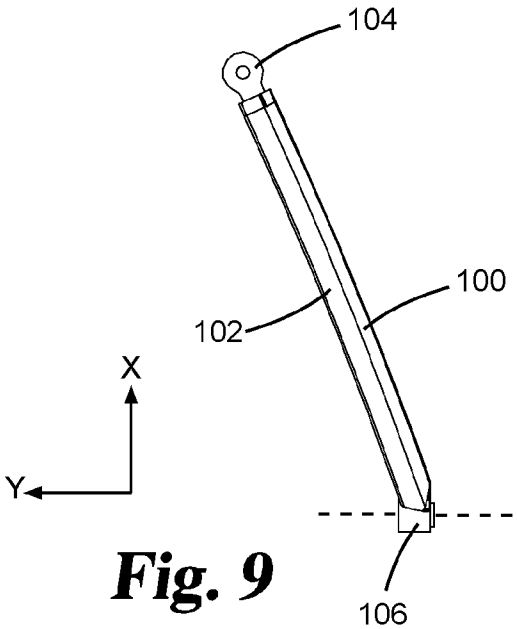
FIG. 9 is a top view of a riser strut for the riser assembly of FIG. 6.

FIGS. 8-10 illustrate side, top and rear views of an example strut 100, with corresponding coordinate axes for reference. In certain embodiments, the struts are formed to be non-linear vertically and horizontally, for example curving laterally outward and upward from the rear to the front. More specifically, in the illustrated embodiments, struts 100 are formed three-dimensionally with lengths which curve outward laterally in the y-axis as the strut extends from the rear to the front in the x-axis (FIG. 9), while also curving upward vertically in the z-axis as the strut extends from the rear to the front in the x-axis (FIG. 8). This creates a lateral offset in the y-axis as well as a vertical offset in the x-axis (FIG. 10). This allows the length of each strut to rise from its rearward mounting location adjacent rail 30 to mate with a wing 54 of crosspiece 51. Separate but related to this strut geometry, the rearward portion 106 of each strut may define a passage with a substantially horizontal axis, while the forward portion 104 of each strut may define a passage with a substantially vertical axis, which can be used for respective fasteners.

As seen in FIGS. 1-5 a pair of flexible limbs 60 extend laterally from riser assembly 50. The illustrated embodiment is sometimes referred to as a reverse crossbow arrangement, where the limbs 60 extend laterally, away from rail 30 and forward, so that the respective limb tips 64 are arranged in the forward direction. In the embodiment shown, the limbs 60 are each formed in a split or quad limb configuration where each of flexible limbs 60 is made using an upper and a lower limb piece with a gap between the pieces. Alternately, each limb could be made in one piece, with a fork or slot for mounting a cam formed at one end and the opposite end being the limb butt.

In other embodiments, the limbs are not limited to pointing in the forward direction. For example, instead of pointing forward the limbs may extend from the riser assembly 50 laterally and rearward to the limb tips with corresponding modifications to the crossbow 10. In this arrangement, the crosspiece of the riser assembly would be located adjacent the forward end of rail 30.

Each limb 60 includes a butt portion 62 which is secured to riser assembly 50 at the limb mounting portions 56. Each limb butt may be received in a limb pocket. The limb pocket includes a cover 66 and an inner boot 67. Slightly spaced forward along the length of each limb is a limb rocker 68, arranged between the inward face of the limb and the outward face adjacent the forward edge of the limb mounting portion 56. Each limb rocker 68 may be mounted to a rocker bar 69, pivotally arranged in a rocker bar hole 57 in the limb mounting portion. An adjustable bolt extending into the crosspiece 51 may be used to compress the limb pocket and limb butt end against the riser assembly.

Figure 11B:
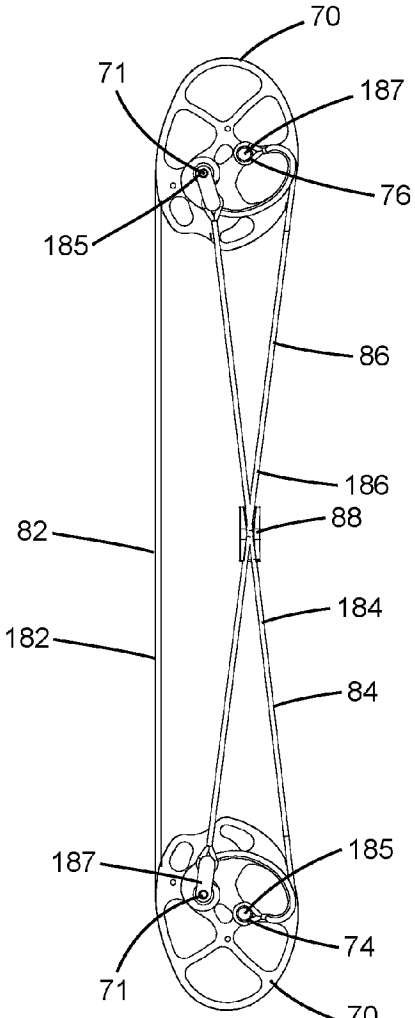
FIG. 11B is a lower view of the cable assembly of the crossbow of FIG. 1.
Figure 11A:
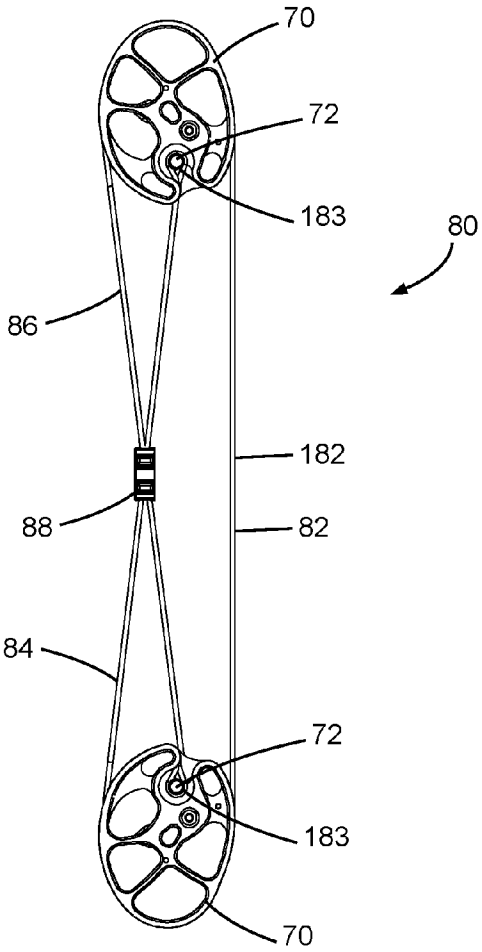
FIG. 11A is a top view of the cable assembly of the crossbow of FIG. 1.
Figure 12:
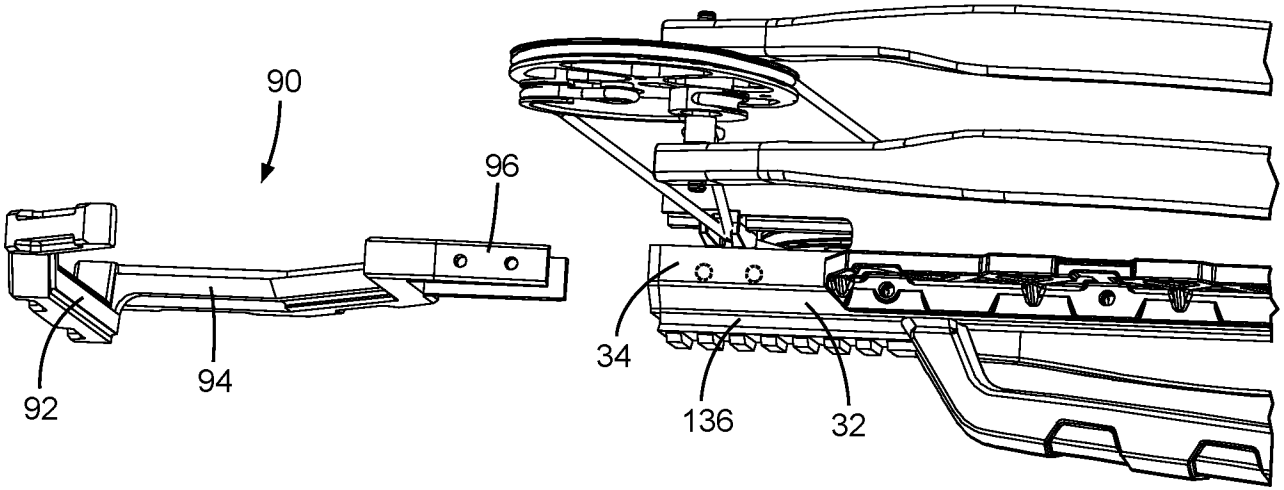
FIG. 12 is a perspective view of a stirrup accessory usable with the crossbow of FIG. 1.

A pair of cams 70 are arranged at the limb tips 64. Cams 70 are rotationally mounted to limb tips 64 on respective axles 71. The cams may be eccentrically mounted on the axles. Cable assembly 80 is arranged between cams 70, as illustrated in a top view FIG. 11A and a bottom view in FIG. 11B. Each cam has two tracks and two anchor points.

Three cables are arranged between the cams. Cable assembly includes bowstring 82. As illustrated, bowstring 82 extends directly between cams 70. Bowstring 82 includes a medial portion 182 tangential to the cams in the undrawn position. Medial portion 182 is drawn to the latch mechanism when the crossbow is drawn and engages a crossbow bolt. Bowstring 82 is arranged and travels within a plane extending parallel to and slightly above the bolt guide surface of rail 30. Bowstring 82 extends to two end portions 183 which each wrap around a track in a respective cam 70, and with opposing ends which are secured to cam anchors 72 on the respective cams. The end portions 183 wrap around the majority of the circumference of cams 182 when undrawn, and are paid out rearwardly as the medial portion is drawn.

In the illustrated embodiment, the bowstring medial portion 182 is arranged on the rear of the cams, closer to the latch assembly. In alternate embodiments, the bowstring medial portion 182 may be arranged along the forward side of the cams, Cable arrangement 80 also includes two power cables 84, 86. Power cable 84 has a medial section 184 and a pair of ends 185. One end 185 is received in a track on one cam 70 and is secured to a cam anchor 74, with the other end 185 secured to the axle 71 of the opposite cam. A cable hanger may be arranged between the end 185 and the axle 71. Examples of cable hangers are illustrated and discussed in provisional application Ser. No. 62/236,261 filed on Oct. 2, 2015, incorporated herein by reference. Alternately a Y-yoke cable section can be used to anchor end 185 to axle 71 above and below the cam to balance the cable force in-line with the cam. Power cable 86 is arranged symmetrically to power cable 84. Power cable 86 has a medial section 186 and a pair of ends 187. One end 187 is received in a track on one cam 70 and is secured to a cam anchor 76, with the other end 187 secured to the axle 71 of the opposite cam. A cable hanger or Y-yoke may be arranged between the end 187 and the axle 71. Alternate cable arrangements can include single cam or hybrid cam cable arrangements.

Optional cable guide 88 is mounted in a forward slot defined in the front portion 34 of rail 30, below the rail upper surface and bolt guide. As the power cables cross the width of the crossbow, the medial sections of the power cables 84 and 86 pass below the upper surface of rail 30 and through cable guide 88. The power cables translate through cable guide 88 during a draw and release cycle of the crossbow.

When the crossbow is drawn by pulling the center 182 of bowstring 82 rearward, cams 70 rotate counterclockwise and clockwise, respectively, so that bowstring medial portion 182 is fed out from the cams down the center of the crossbow 10 over the rail 30. Meanwhile, the rotation of cams 70 causes power cables 84 and 86 to have one end portion wrap around and into respective cam tracks. This causes limbs 60 to bend inward and to store energy. The power cables 84, 86 and cam tracks are synchronized to balance the loads on respective limbs 60.

Once fully drawn, bowstring 82 is secured at a nock point using the latch mechanism 45. The latch mechanism 45 holds the bowstring 82 until the crossbow is ready to be fired. A bolt is inserted onto the bolt guide groove in rail 30, and the end of the bolt is positioned on the bowstring 82 at a nocking point. Once the bolt is situated on rail and positioned on the bowstring nock point, the crossbow 10 is ready to be fired upon operation of trigger 40.

Certain embodiments include a stirrup piece accessory 90, which may be held on the ground by a user's foot while drawing/cocking crossbow 10. In the illustrated embodiment, stirrup 90 includes a step portion 92 substantially perpendicular to the longitudinal axis of rail 30, a forward extending portion 94 and rear mounting portion 96. Forward extending portion 94 allows step portion 92 to be offset forward from the front end 34 of rail 30.

In certain preferred embodiments, stirrup 90 and step portion 92 are open or discontinuous on one side, defining a gap between the step portion 92 and the rear mounting portion 96. This can be characterized as hook or approximately L-shaped. The gap allows a user to place a foot (typically with a shoe or boot) onto the step portion 92 laterally rather than toe-first. Optionally, the hook-shape of stirrup 90 allows the stirrup to be used to hang crossbow 10 and/or as a handle for carrying crossbow 10. Optionally, the terminal end of step portion 92 may have an end piece, such as a short rearward angled portion, which assists in centering a user's foot on the step portion, and which may also enhance the ability of stirrup to act as a hook without disengaging from the item it hooks onto.

The rear mounting portion 96 can be secured to the forward end 34 of rail 30. In the illustrated embodiment, mounting portion 96 defines a fork arrangement with opposing parallel prongs which can be arranged flat against opposing sides of rail 30. Mounting portion 96 can be secured to rail 30 using fasteners such as screws, or alternate fasteners such as bolts, rivets, adhesive or metal bonding, such as welding. Alternately, stirrup 90 can be made integrally with rail 30. In certain embodiments, mounting portion 96 is arranged below cable slide 88 and above accessory rail 136. Stirrup 96 is typically substantially flat or planar and does not obstruct operation of an accessory mounted on rail 136 such as a flashlight, a laser pointer or a camera.

In the embodiment shown, portions of the stock 20 near butt end 22, in crosspiece 51 and in finger guards 138 have been removed to reduce the weight of the crossbow. Other embodiments may have different amounts of material removed in different patterns or may have no material removed.

Other embodiments of crossbow system 100 may have additional accessories attached to stock assembly 110 or other portions of the crossbow. For example, some embodiments may include any or all of the following: a scope, a dry-fire prevention mechanism, a safety, a cocking mechanism, one or more stabilizers, a pole, bipod or tripod mount, one or more vibration dampeners, a quiver, a flashlight, a laser pointer and/or a camera.

Components of crossbow 10 may be made from any material that allows for effective operation of the crossbow. The material for different pieces of the crossbow 10 may vary within the same embodiment. For example, in some embodiments, pieces of the crossbow 10 may be made using metal, such as aluminum or steel, composites like carbon fiber or any of a variety of plastics or polymers and/or from wood. As would be understood by those of skill in the art, various fasteners or fastening methods may be used to assemble the components of crossbow 10, but have not been illustrated or discussed in detail.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A crossbow assembly, comprising:

a rail and stock assembly;

a crosspiece with a center portion mounted perpendicular to said rail and stock assembly, said crosspiece having a pair of lateral wings extending to limb mounting portions, wherein said crosspiece defines a pair of openings adjacent said limb mounting portions;

a pair of limbs extending from said limb mounting portions;

a rail insert arranged internally in said rail and stock assembly; and a pair of bracing struts extending rearward from said lateral wings, wherein forward ends of said bracing struts are received in said pair of openings and wherein rearward ends of said bracing struts are anchored to said rail insert.

2. The crossbow assembly of claim 1, wherein each crosspiece opening defines a vertical entrance in the crosspiece and a horizontal slot along the rearward edge of the cross piece, and wherein the forward end of each bracing strut is sized to vertically fit within the vertical entrance yet has a cross-section larger than the horizontal slot, so that the crosspiece opening receives the bracing strut forward end vertically but prevents the forward end from exiting the opening horizontally.

3. The crossbow assembly of claim 2, wherein each strut has a neck portion passing through the horizontal slot, and wherein the horizontal slot width is larger than the neck portion, allowing the bracing strut to pivot within a range defined by the slot width.

4. The crossbow assembly of claim 1, wherein a rail wall portion is sandwiched between a bracing strut and said rail insert.

5. The crossbow assembly of claim 1, comprising a single fastener anchoring said pair of bracing struts to said rail insert.

6. The crossbow assembly of claim 1, comprising a pair of fasteners, each fastener anchoring a bracing strut to said rail insert.

7. The crossbow assembly of claim 1, wherein said rail insert includes at least one threaded opening for receiving a fastener.

8. The crossbow assembly of claim 1, wherein said rail insert is formed of a different material than the material of the rail.

9. A crossbow assembly, comprising:

a rail and stock assembly;

a crosspiece with a center portion mounted perpendicular to said rail and stock assembly, said crosspiece having a pair of lateral wings extending to limb mounting portions, wherein said crosspiece defines a pair of openings adjacent said limb mounting portions;

a pair of limbs extending from said limb mounting portions; and, a pair of bracing struts extending rearward from said lateral wings to said rail and stock assembly;

wherein each crosspiece opening defines a vertical entrance in the crosspiece and a horizontal slot along the rearward edge of the crosspiece, and wherein the forward end of each bracing strut is sized to vertically fit within the vertical entrance yet has a cross-section larger than the horizontal slot, so that the crosspiece opening receives the bracing strut forward end vertically but prevents the forward end from exiting the opening horizontally.

10. The crossbow assembly of claim 9, wherein each strut has a neck portion passing through the horizontal slot, and wherein the horizontal slot width is larger than the neck portion, allowing the bracing strut to pivot within a range defined by the slot width.

11. The crossbow assembly of claim 9, wherein a rearward portion of each strut defines a fastener passage with a substantially horizontal axis and a forward end of each strut defines a fastener passage with a substantially vertical axis.

12. The crossbow assembly of claim 9, wherein said bracing struts are non-linear both vertically and horizontally.

13. The crossbow assembly of claim 9, wherein said wings rise in height from the center portion to said limb mounting portions, and are configured so that said limb mounting portions are offset in height from the center portion.

14. The crossbow assembly of claim 9, wherein said wings are each angled outward and rearward in profile from a top perspective.

15. The crossbow assembly of claim 14, comprising a pair of limbs extending forward from said limb mounting portions.

16. A crossbow assembly, comprising:

a rail and stock assembly;

a crosspiece with a center portion mounted perpendicular to said rail and stock assembly, said crosspiece having a pair of lateral wings extending to limb mounting portions;

wherein said wings rise from the center portion to said limb mounting portions, and are configured so that said limb mounting portions are offset in height from the center portion;

wherein said wings are each angled outward and rearward in profile from a top perspective; and, a pair of limbs secured to said limb mounting portions.

17. The crossbow assembly of claim 16, wherein each wing has a linearly sloped rear edge and a linearly sloped forward edge wherein each rear edge has a slope extending from said center portion to the respective limb mounting portion which is steeper than the slope extending along the wing forward edge.

18. The crossbow assembly of claim 16, wherein said limb mounting portions have edges which form angles that diverge relative to the forward axis of said rail.

19. The crossbow assembly of claim 16, wherein the rear corners of said limb mounting portions are horizontally closer to the axis of said rail than the forward corners.

20. The crossbow assembly of claim 19, wherein said limbs extend forward from said limb mounting portions.

* * * * *